US008834104B2

(12) United States Patent
Mohamed et al.

(10) Patent No.: US 8,834,104 B2
(45) Date of Patent: Sep. 16, 2014

(54) VANES FOR DIRECTING EXHAUST TO A TURBINE WHEEL

(75) Inventors: Ashraf Mohamed, Torrance, CA (US); Scott MacKenzie, San Pedro, CA (US); Shakeel Nasir, Torrance, CA (US); Mark Groskreutz, Tyler, TX (US)

(73) Assignee: Honeywell International Inc., Morristown, NJ (US)

( * ) Notice: Subject to any disclaimer, the term of this patent is extended or adjusted under 35 U.S.C. 154(b) by 960 days.

(21) Appl. No.: 12/823,504

(22) Filed: Jun. 25, 2010

(65) Prior Publication Data

US 2011/0314808 A1 Dec. 29, 2011

(51) Int. Cl.

| | |
|---|---|
| ***F01D 9/04*** | (2006.01) |
| ***F01D 17/16*** | (2006.01) |
| ***F01D 5/14*** | (2006.01) |

(52) U.S. Cl.

CPC ..... *F01D 5/141* (2013.01); *F01D 17/165* (2013.01); *F05D 2220/40* (2013.01)

USPC ..... 415/164

(58) Field of Classification Search

USPC ..... 415/160, 163–185

See application file for complete search history.

(56) References Cited

U.S. PATENT DOCUMENTS

| | | | | |
|---|---|---|---|---|
| 5,299,909 | A * | 4/1994 | Wulf | 415/186 |
| 6,050,775 | A | 4/2000 | Erdman et al. | |
| 6,709,232 | B1 * | 3/2004 | Vogiatzis | 415/163 |
| 6,755,612 | B2 * | 6/2004 | Shahpar et al. | 415/192 |
| 6,948,907 | B2 * | 9/2005 | Vogiatzis et al. | 415/160 |
| 7,001,143 | B2 * | 2/2006 | Vogiatzis | 415/163 |
| 7,147,433 | B2 | 12/2006 | Ghizawi | |
| 7,255,530 | B2 | 8/2007 | Vogiatzis et al. | |
| 7,393,177 | B2 * | 7/2008 | Rahai et al. | 415/4.2 |
| 2007/0107426 | A1 | 5/2007 | Castan | |
| 2007/0140837 | A1 | 6/2007 | Guemmer | |
| 2007/0231148 | A1 * | 10/2007 | Lehoczky | 416/223 R |
| 2008/0260528 | A1 | 10/2008 | Weber et al. | |

FOREIGN PATENT DOCUMENTS

| | | | |
|---|---|---|---|
| EP | 1790830 | A1 | 5/2007 |
| GB | 2467382 | A | 8/2010 |
| WO | 9519499 | A2 | 7/1995 |
| WO | 9519499 | A3 | 8/1995 |
| WO | 2009086959 | A1 | 7/2009 |
| WO | 2010052911 | A1 | 5/2010 |

OTHER PUBLICATIONS

European Search Report of Dec. 5, 2011 for Application No. 11170590.1 (6 pages).

European Exam Report and Annex of Dec. 27, 2011 for Application No. 11170590.1 (6 pages).

* cited by examiner

*Primary Examiner* — Ned Landrum
*Assistant Examiner* — Woody A Lee, Jr.
(74) *Attorney, Agent, or Firm* — Brian J. Pangrle

(57) ABSTRACT

A vane for a turbine assembly of a turbocharger includes an airfoil that has a pair of flow surfaces disposed between a hub end and a shroud end and a leading edge and a trailing edge where the airfoil further includes a non-zero sweep angle, a non-zero lean angle, a non-zero twist angle or any two or more combinations thereof. Various other examples of devices, assemblies, systems, methods, etc., are also disclosed.

21 Claims, 11 Drawing Sheets

Sweep 710

| | Sweep + 16.6 Degrees | Sweep - 16.6 Degrees |
|---|---|---|
| Ex 1 | 0.87 Strain (norm) | 0.76 Strain (norm) |
| | Sweep + 17.3 Degrees | Sweep - 17.3 Degrees |
| Ex 2 | 0.85 Strain (norm) | 0.71 Strain (norm) |

Lean 720

| | Lean + 8.5 Degrees | Lean - 8.5 Degrees |
|---|---|---|
| Ex 1 | 0.88 Strain (norm) | 1 Strain (norm) |
| | Lean + 8.9 Degrees | Lean - 8.9 Degrees |
| Ex 2 | 0.86 Strain (norm) | 0.96 Strain (norm) |

Twist 730

| | Twist + 5 Degrees | Twist - 5 Degrees |
|---|---|---|
| Ex 1 | 0.92 Strain (norm) | 0.92 Strain (norm) |
| | Twist + 5 Degrees | Twist - 5 Degrees |
| Ex 2 | 0.87 Strain (norm) | 0.89 Strain (norm) |

Fig. 7

Combinations of Features 1010

| | Combination | Normalized Strain |
|---|---|---|
| Ex 2 | Sweep - and Lean + | 0.73 |
| Ex 2 | Sweep - and Twist + | 0.76 |
| Ex 2 | Sweep -, Lean + and Twist + | 0.65 |

Sweep (-17.3 degrees) and Lean (+8.9 degrees); Twist at Shroud to Close Vane 1020

| | Combination | Throat Area | Normalized Strain |
|---|---|---|---|
| Ex 2A (3D) | PC = 97.14 mm | 325 $mm^2$ | 0.74 |
| Ex 2B (3D) | PC = 98.00 mm | 325 $mm^2$ | 0.70 |
| Ex 2A (2D) | PC = 97.14 mm | 315 $mm^2$ | 1 |

PC = Pitch Circle Diameter

Fig. 10

VANES FOR DIRECTING EXHAUST TO A TURBINE WHEEL

TECHNICAL FIELD

Subject matter disclosed herein relates generally to turbomachinery for internal combustion engines and, in particular, vanes for directing exhaust to a turbine wheel.

BACKGROUND

Conventional vanes for directing exhaust to a turbine wheel are typically "stacked". Stacking refers to a 2D airfoil contour or profile that is extruded along a vane axis. The extrusion axis for a rotatable vane of a variable geometry turbine typically coincides with a vane's rotational axis as associated with a vane post. The single 2D airfoil contour of a conventional vane dictates the vane's control torque and wake. Control torque impacts control specifications and wear and wake impacts turbine wheel performance. The conventional single 2D airfoil contour approach has proven suboptimal as to providing adequate solutions to torque and wear issues. As described herein, various vanes provide enhanced torque and wear performance characteristics when compared to conventional single 2D airfoil contour vanes.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with the accompanying drawings where:

FIG. 7 is a series of tables of trial data for various sweep, lean and twist values;

FIG. 10 is a series of tables of trial data for various combinations of features.

DETAILED DESCRIPTION

Figure 1:
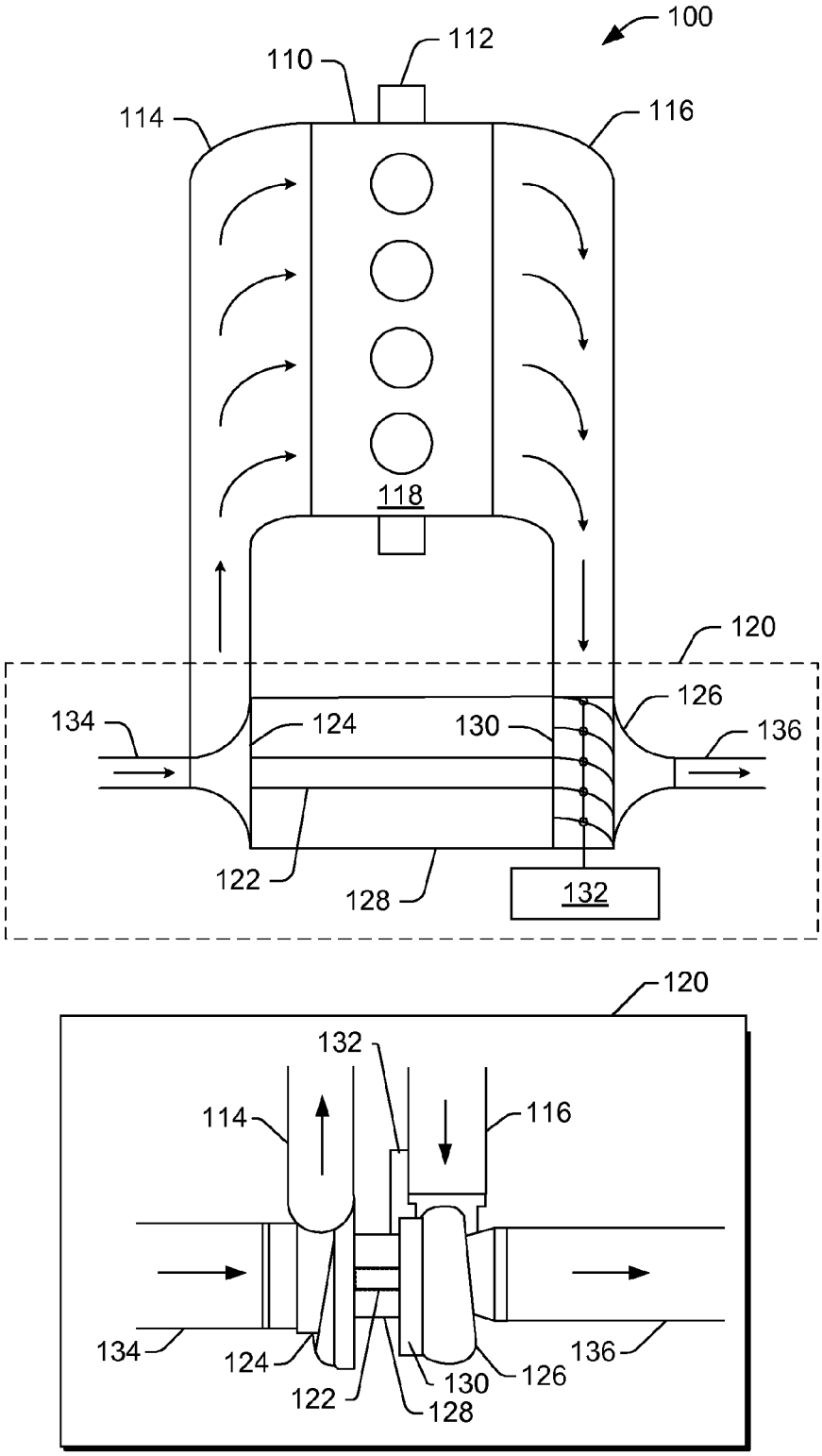
FIG. 1 is a diagram of a turbocharger and an internal combustion engine.

Vane design in a variable nozzle turbine relates to wear and durability of a turbocharger. Vane airfoil characteristics determine, in part, torque generated about a vane's control axle as well as the wake created, which impacts turbine wheel performance and reliability. As to vane airfoil characteristics, certain characteristics benefit torque reduction and certain characteristics benefit wake reduction. As described herein, in various examples, vanes are presented that have beneficial characteristics. In particular, various vanes presented herein demonstrate that different types of airfoil contours can combined to optimize a vane. At times, such an approach is referred to as contour blending, where multiple contours are blended together to minimize both control torque and wake.

Contour blending can interpolate multiple contours to create a 3D surface. For example, a 3D surface of a vane can include variation with respect to vane height. Such variation may be represented, in part, by a twist angle (e.g., stagger angle variation along a vane height). In various examples, a 3D vane includes one or more of the following features that vary with respect to vane height: stagger angle, length from leading edge to trailing edge, meanline angle and thickness (e.g., vane width). While vane height typically remains constant with respect to a direction along length of a vane, a vane may further include a variation in vane height. Trial data presented herein demonstrate enhanced performance characteristics of contour blending.

In various examples, a vane can be used in a conventional variable geometry turbine, however, to take advantage of enhanced performance characteristics, a turbine wheel may be configured to match a vane. Such a turbine wheel may be referred to as a turbine wheel configured for a contour blended vane. In particular, improved wake of a contour blended vane enables a turbine wheel to be created that is more efficient than conventional turbine wheels, for example, as used in conventional variable geometry turbines.

Various vanes described herein stem from analyses of contours that yield, for example, flat torque characteristics at various vane staggered angle (vane positions). Trial data from computational fluid dynamics (CFD) analyses demonstrate that several by increasing aerodynamic torque acting on a vane pivot axel at unloaded vane positions (zero and close to zero angle of attack with incoming flow) torque reversal is reduced or eliminated at low vane expansion ratios (ERs). By reducing aerodynamic torque acting on a vane pivot axel at highly loaded vane positions (high angle of attack with the incoming flow), wear and actuation forced required to adjust (e.g., rotate a vane about a pivot axel) are reduced for an assembly that includes a plurality of vanes.

Design parameters of such vanes include, for example: (a) mean line camber angles distribution: constructed with multiple of inflection points of negative and positive camber to achieve the target torque characteristics; (b) upper and lower surface thickness distribution (e.g., usually same on both sides to the mean line); (c) vane pivot axial and radial location relative to the meanline (e.g., positioned on one side of the aerodynamic center of pressure to prevent aero torque directional reversal); (d) leading edge and trailing edge radius; (e) vane length (e.g., constrained to be greater or equal to minimum value needed is to guarantee vane to vane closing (zero flow area between vanes).

As discussed further below, vane torque and high cycle fatigue (HCF) results were analyzed and compared with existing vane designs. Various 3D contour blended vanes described herein were configured with one or more of 3D vane sweep, lean and twist angles to reduce vane trailing edge wake and shock intensity of rotor/stator interactions thereby reducing unsteady turbine blade loading while meeting desired torque characteristics (e.g., no directional reversal and lower actuation force). For a "3D" vane, as defined herein, a sweep angle, a lean angle or a twist angle is a non-zero angle. Examples of 2D and 3D vanes exhibited, via CFD analyses, superior torque characteristics to compared to baseline designs. Such vanes are suitable for use with conventional variable geometry turbines (e.g., GT35 DAVNT™ and GT22 AVNT™ marketed by Honeywell Transportation and Power Systems).

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112. As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components.

Such a turbocharger may include one or more variable geometry units, which may use multiple adjustable vanes, an adjustable diffuser section, a wastegate or other features to control the flow of exhaust (e.g., variable geometry turbine) or to control the flow of intake air (e.g., variable geometry compressor). In FIG. 1, the turbocharger 120 further includes a variable geometry mechanism 130 and an actuator or controller 132. The variable geometry mechanism 130 provides for adjusting or altering flow of exhaust to the turbine 126.

Adjustable vanes positioned at an inlet to a turbine can operate to control flow of exhaust to the turbine. For example, GARRETT® VNT® turbochargers adjust the exhaust flow at the inlet of a turbine in order to optimize turbine power with the required load. Movement of vanes towards a closed position typically directs exhaust flow more tangentially to the turbine, which, in turn, imparts more energy to the turbine and, consequently, increases compressor boost. Conversely, movement of vanes towards an open position typically directs exhaust flow in more radially to the turbine, which, in turn, reduces energy to the turbine and, consequently, decreases compressor boost. Closing vanes also restrict the passage there through which creates an increased pressure differential across the turbine, which in turn imparts more energy on the turbine. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies.

Figure 2:
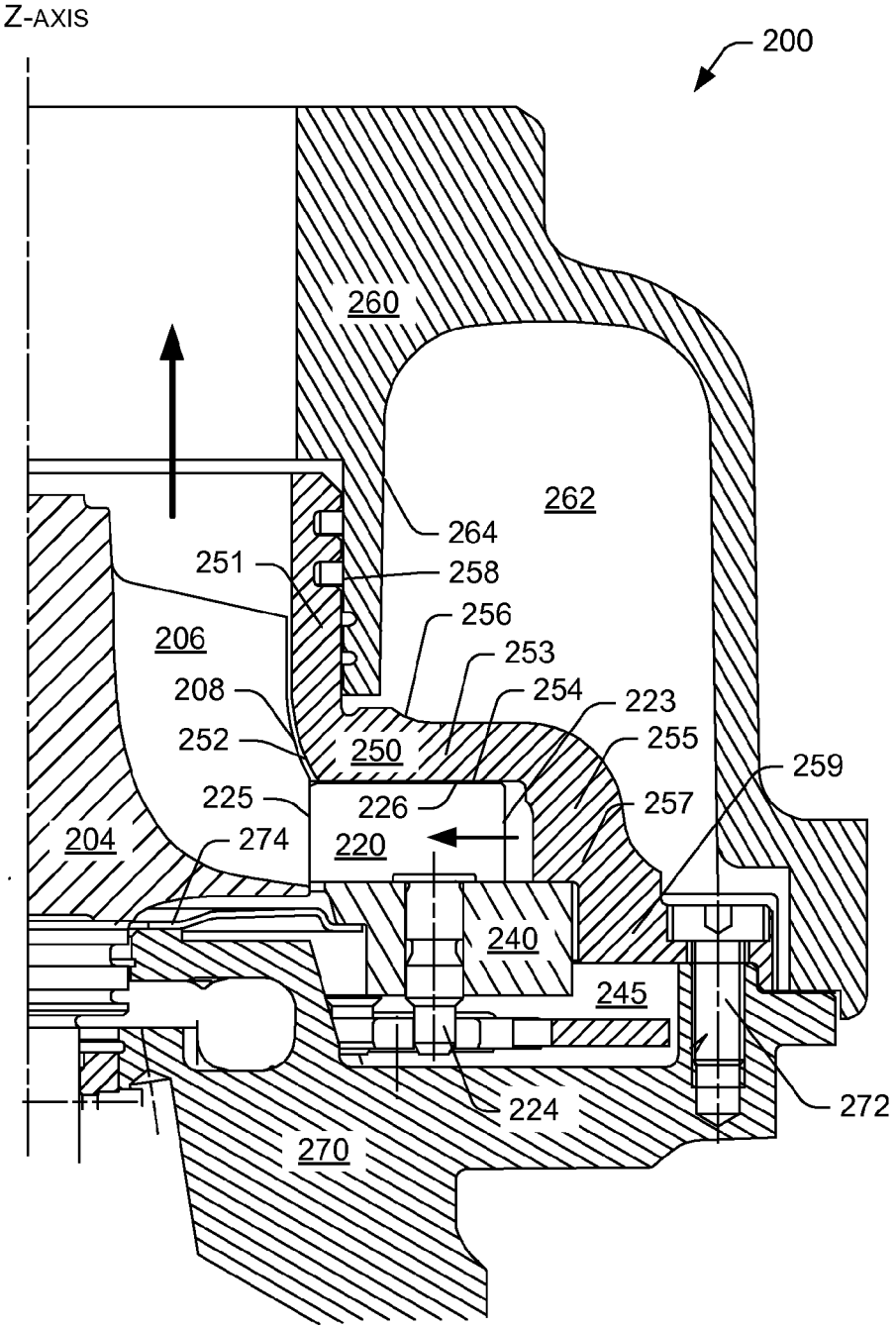
FIG. 2 is a cross-sectional view of a turbine assembly that includes adjustable vanes to direct exhaust to a turbine wheel.

FIG. 2 shows a cross-sectional view of a turbine assembly 200 having a turbine wheel 204 and vanes (see, e.g., the vane 220) associated with a variable geometry mechanism. The turbine assembly 200 may be part of a turbocharger such as the turbocharger 120 of FIG. 1. In the example of FIG. 2, the turbine wheel 204 includes a plurality of blades (see, e.g., the blade 206) that extend primarily in a radial direction outward from the z-axis. The blade 206, which is representative of other blades, has an outer edge 208 where any point thereon can be defined in an r, Θ, z coordinate system (i.e., a cylindrical coordinate system). The outer edge 208 defines an exducer portion (where exhaust exits) and an inducer portion (where exhaust enters). The vane 220 directs exhaust to the inducer portion of the turbine wheel 204.

In the example of FIG. 2, the vane 220 is positioned on an axle or post 224, which is set in a vane base 240, which may be part of a variable geometry mechanism. As shown, the post 224 is aligned substantially parallel with the z-axis of the turbine wheel 204 and includes an upper surface 226. While the post 224 is shown as not extending beyond the upper surface 226, in other examples, a post may be flush with the upper surface 226 or extend above the upper surface 226 (e.g., received by a receptacle of the housing 250, etc.).

With respect to adjustments, a variable geometry mechanism can provide for rotatable adjustment of the vane 220 along with other vanes to alter exhaust flow to the blades of the turbine wheel 204. In general, an adjustment adjusts an entire vane and typically all of the vanes where adjustment of any vane also changes the shape of the flow space between adjacent vanes (e.g., vane throats or nozzles). In FIG. 2, arrows indicate general direction of exhaust flow from an inlet end 223 to an outlet end 225 of the vane 220. As mentioned above, adjustments toward "open" direct exhaust flow more radially to the turbine wheel 204; whereas, adjustments toward "closed" direct exhaust flow more tangentially to the turbine wheel 204.

The turbine assembly 200 is a particular example; noting that various vanes described herein may be implemented in other types of turbine assemblies. In the example of FIG. 2, the assembly 200 has an insert 250 that includes, from the top down (i.e., along the z-axis): a substantially cylindrical or tubular portion 251; a substantially planar, annular portion 253; one or more extensions 255; a leg or step portion 257; and a base portion 259. The base portion 259 extends to an opening configured for receipt of a bolt 272 to attach the insert 250 to a center housing 270. As shown in FIG. 2, a turbine housing 260 seats over the insert 250 and forms a volute 262, defined at least in part by a volute side surface 264 of the housing 260 and a volute side surface 256 of the inset 250. The volute 262 receives exhaust (e.g., from one or more cylinders of an engine) and directs the exhaust to the vanes.

During sharp operational transients, forces acting on a vane may affect operability or longevity. Such forces may be from flow of exhaust past surfaces of a vane, pressure differentials (e.g., between a command space 245 and vane space), or one or more other factors.

The controller 132 of FIG. 1 may be in communication with an engine control unit (ECU) that includes a processor and memory. The ECU may provide the controller 132 with any of a variety of information (e.g., instructions, throttle, engine speed, etc.) and the controller 132 may likewise provide the ECU with information (e.g., vane position, etc.). The controller 132 may be programmed by the ECU or by other techniques. The controller 132 may include a processor and memory, optionally as a single integrated circuit (e.g., a chip) or as more than one integrated circuit (e.g., a chipset).

Figure 3:
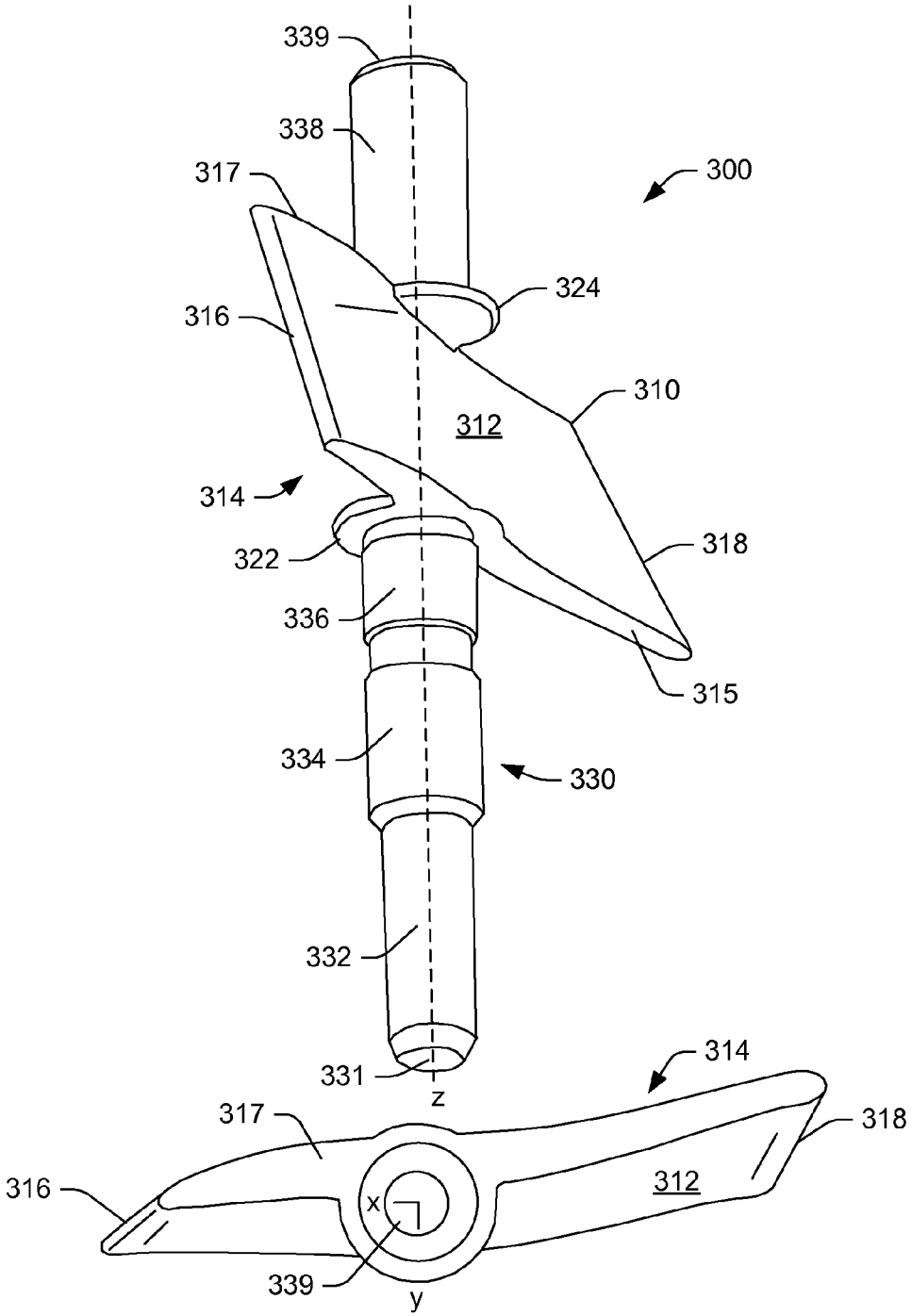
FIG. 3 is a perspective view of a vane with sweep, lean and twist.

As mentioned, various vanes presented herein include one or more contours that enhance performance, particularly with respect to torque and wake. FIG. 3 shows an example of a vane 300 with blended contours. The vane 300 includes an airfoil 310 set on a post 330 between a lower post fixture 322 and an upper post fixture 324. The airfoil 310 includes a pair of flow surfaces 312, 314 disposed between a leading edge (LE) 316 and a trailing edge (TE) 318 and between a lower, hub surface (HS) 315 and an upper, shroud surface (SS) 317. In the example of FIG. 3, the post 330 includes post ends 331 and 339 with various cylindrical surfaces 332, 334, 336 and 338 disposed therebetween. The vane 300 may be configured with one or more different type of post configurations or, more generally, means for fixation or rotation. For example, the vane 300 may include only a lower post and be suitable for use in the turbine assembly 200 of FIG. 2.

Figure 4:
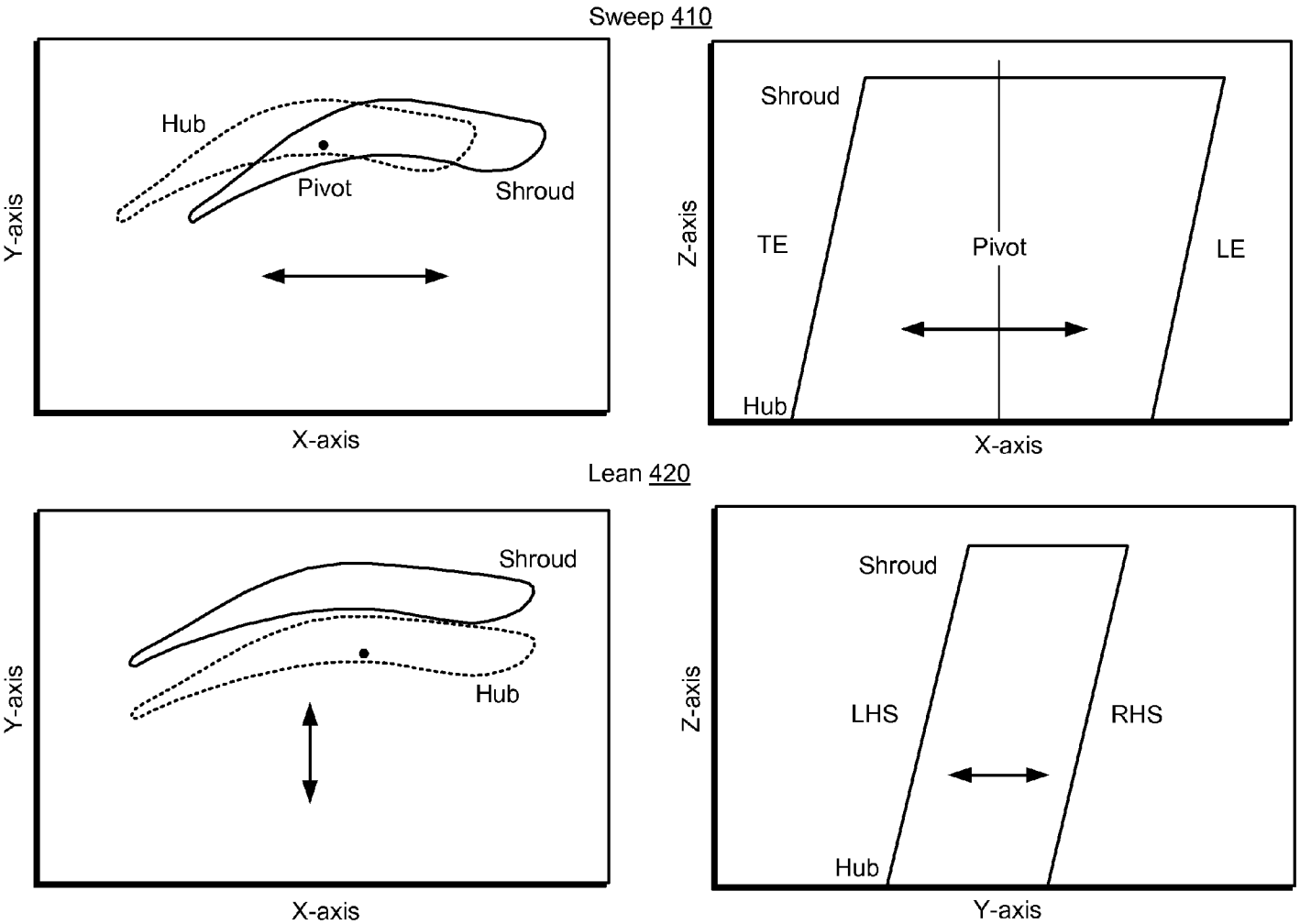
FIGS. 4 and 5 are plots to illustrate sweep, lean and twist as well as camberline features.
Figure 5:
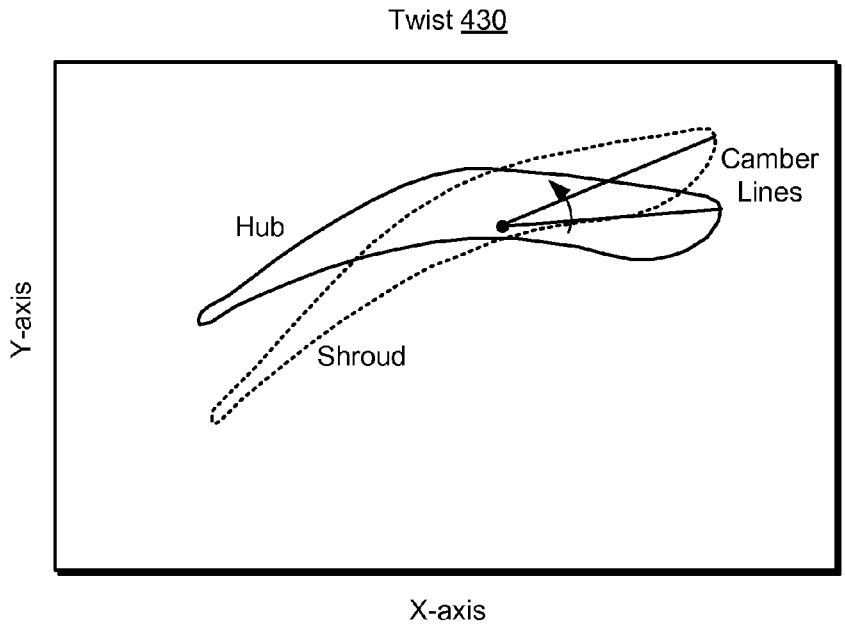
Figure 5:
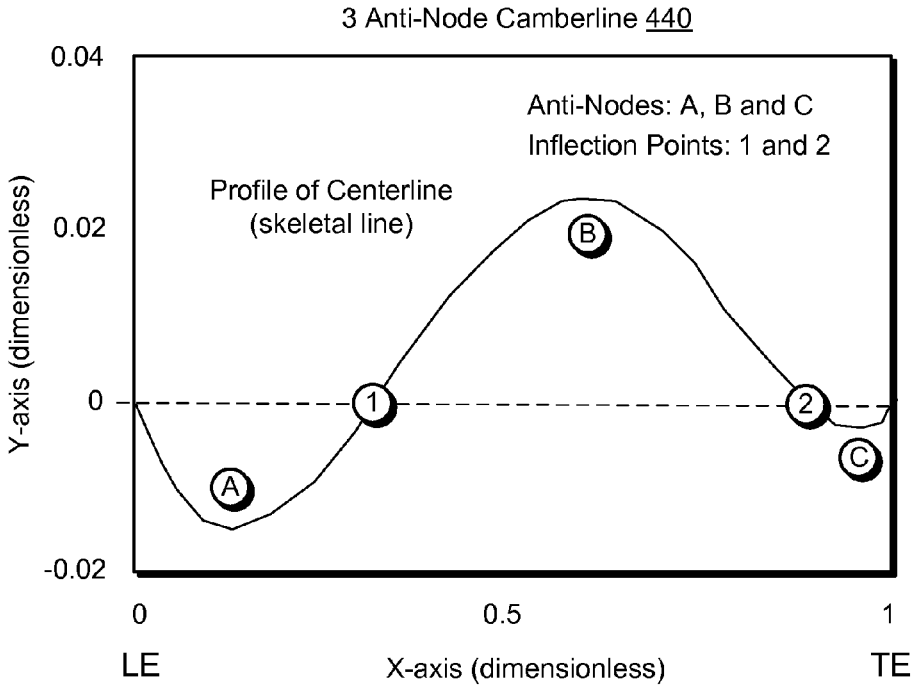

The vane 300 is swept, leaned and twisted and has three anti-nodes along its camberline (e.g., three critical points with an inflection point located between two adjacent critical points). FIGS. 4 and 5 show various plots 410, 420, 430 and 440 that illustrate the sweep, lean, twist and camberline features of the vane 300. In FIG. 4, a pair of plots 410 shows vane sweep, which can be defined as an angle with respect to a pivot axis for a given value along an x-axis. Specifically, in the example of FIG. 4, the angle sweeps the shroud end of the vane in a positive direction along the x-axis with respect to the hub end of the vane (e.g., a positive x offset). Another pair of plots 420 shows vane lean, which can be defined as an angle with respect to a y-axis. Specifically, in the example of FIG. 4, the angle leans the shroud end in a positive direction along the y-axis with respect to the hub end of the vane (e.g., a positive y offset).

FIG. 5 shows the plots 430 and 440, which relate to the camberline(s). In the plot 430, a twist angle is shown between a camberline for a hub contour and a shroud contour. In all of the examples of FIGS. 4 and 5, the vane or airfoil contour may be the same yet not stacked due to sweep, lean or twist or a combination of these transforms. While the plot 440 shows a particular camberline profile with three anti-nodes (or critical points A, B and C) and two inflection points (1 and 2), other camberline profiles are possible as well. The camberline profile of the plot 440 describes how the camberline varies with respect to the y-axis (dimensionless) along the length of the vane (x-axis, dimensionless) between a leading edge (LE=0) and a trailing edge (TE=1) of a vane such as the vane 300 of FIG. 3.

A 2D contour of a low torque vane can include various features in its camber sheet design that improve torque characteristics of the vane. For example, inflection at or near the leading edge of a camber sheet from negative to positive camber has been shown to improve controllability (e.g., inflection point "1", between critical points "A" and "B" in FIG. 5). As described herein, an additional inflection point (e.g., inflection point "2", between critical points "B" and "C", from positive to negative), can provide for further benefits with respect to controllability. In the example of FIG. 5, the second inflection point (inflection point "2", between critical points "B" and "C") is about 75% to about 100% (TE=1) of the meridonal length as measured from the leading edge of a vane (LE=0). The magnitude of the third anti-node or (critical point "C") is about −0.002 on the y-axis (dimensionless).

As described herein, a vane for a turbine assembly of a turbocharger can include an airfoil with a pair of flow surfaces disposed between a hub end and a shroud end and a leading edge and a trailing edge where the airfoil includes at least two inflection points and at least three anti-nodes along a camberline. In such an example, a normalized length of the camberline can range from 0 at the leading edge to 1 at the trailing edge where, for example, at least one inflection point has a position of at least 0.75. As shown in the example of FIG. 5, a vane can include at least two anti-nodes with positions of less than 0.75. In the example of FIG. 5, the vane has three anti-nodes positioned at approximately 0.2, approximately 0.7 and approximately 0.9, respectively, and with two inflection points.

As described herein, a vane can include an inflection point positioned along a first half of a camberline and another inflection point positioned along a second half of the camberline. Where the camberline is defined from a leading edge to a trailing edge, the inflection point along the first half may be from negative to positive and the inflection point along the second half may be from positive to negative. With respect to anti-nodes (or critical points), a vane may have its smallest magnitude critical point closest to the trailing edge. As described herein, an intermediate anti-node of a vane can have the greatest magnitude of a group of three or more anti-nodes.

As described herein, a turbocharger can include a center housing disposed between a compressor and a variable geometry turbine where the variable geometry turbine includes a plurality of vanes where each vane includes an airfoil with a pair of flow surfaces disposed between a leading edge and a trailing edge and at least two inflection points and at least three anti-nodes along a camberline that extends from the leading edge to the trailing edge.

Figure 6:
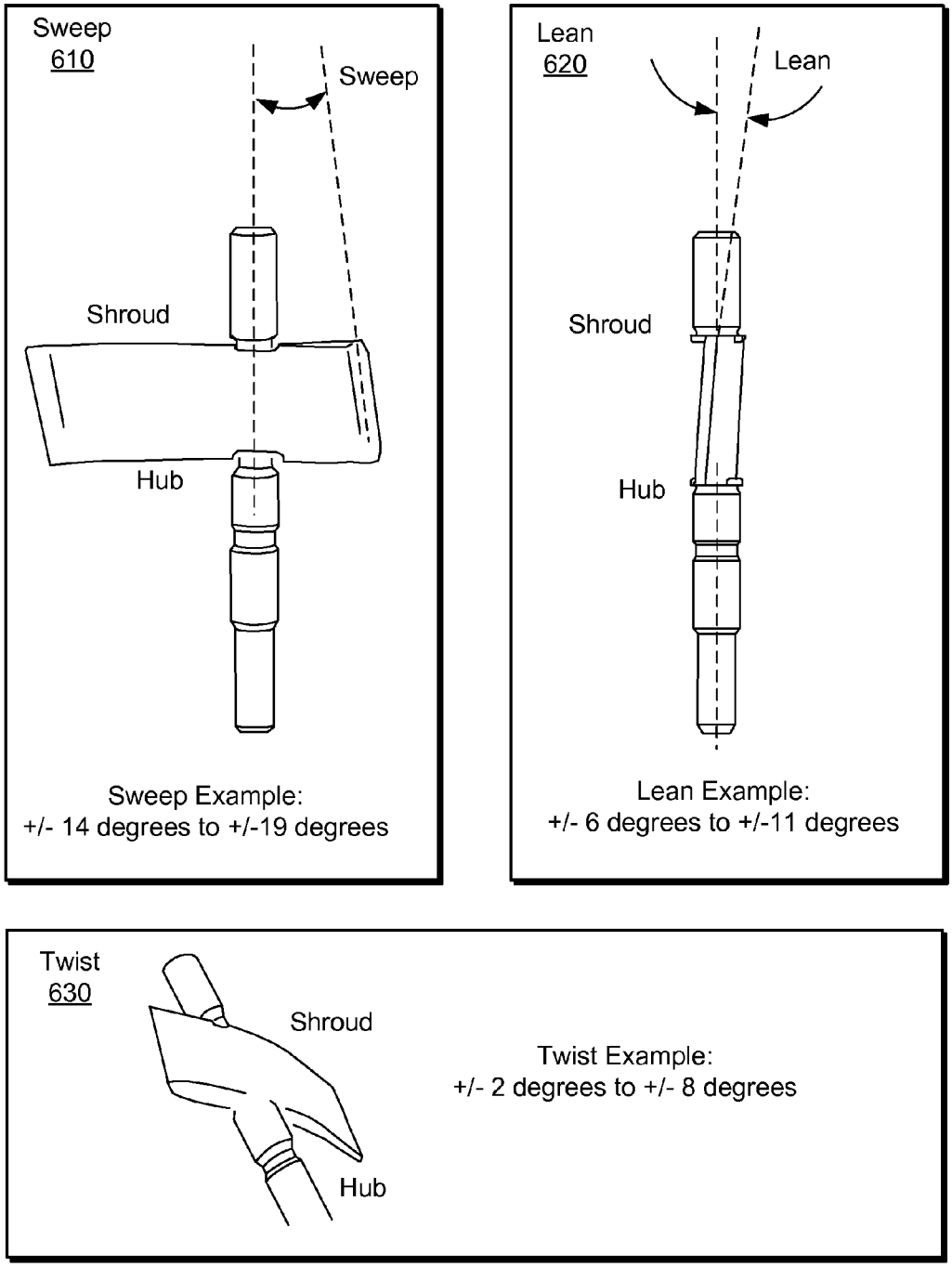
FIG. 6 is a series of views of a vane to illustrate sweep, lean and twist features.

FIG. 6 shows sweep 610, lean 620 and twist 630 for a vane along with some examples of degrees.

FIG. 7 shows various trial data from CFD analyses for sweep 710, lean 720 and twist 730. The trials pertain to two examples, referred to as "Ex 1" and "Ex 2". These examples were modified by choosing plus and minus angles for sweep, lean and twist. As to sweep 710, a negative angle reduced strain for both examples. As to lean 720, a positive angle reduced strain for both examples. As to twist 730, for Ex 1, a negative angle reduced strain whereas for Ex 2, a positive angle reduced strain. The trial data for twist 730 demonstrates that twist in a positive or a negative angle may not necessary result in reduction of strain. Particularly, underlying configuration of a vane needs to be understood with respect to twist angle and strain.

Figure 8:
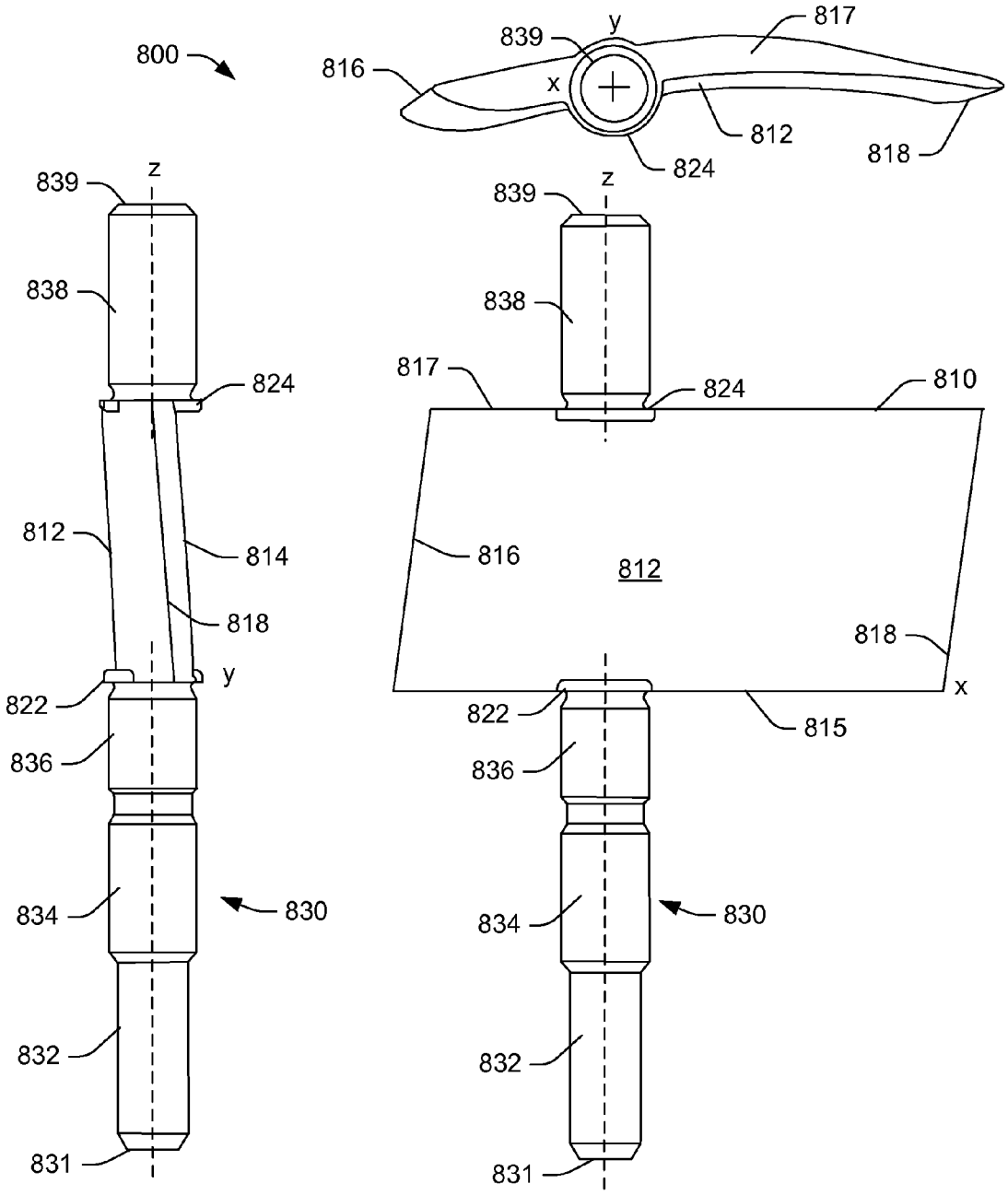
FIG. 8 is a series of views of an example of a vane.

FIG. 8 shows an example of a vane 800 with enhanced performance characteristics achieved via blended contours (3D). The vane 800 includes an airfoil 810 set on a post 830 between a lower post fixture 822 and an upper post fixture 824. The airfoil 810 includes a pair of flow surfaces 812, 814 disposed between a leading edge (LE) 816 and a trailing edge (TE) 818 and between a lower, hub surface (HS) 815 and an upper, shroud surface (SS) 817. In the example of FIG. 8, the post 830 includes post ends 831 and 839 with various cylindrical surfaces 832, 834, 836 and 838 disposed therebetween. The vane 800 may be configured with one or more different type of post configurations or, more generally, means for fixation or rotation. For example, the vane 800 may include only a lower post and be suitable for use in the turbine assembly 200 of FIG. 2.

Figure 9:
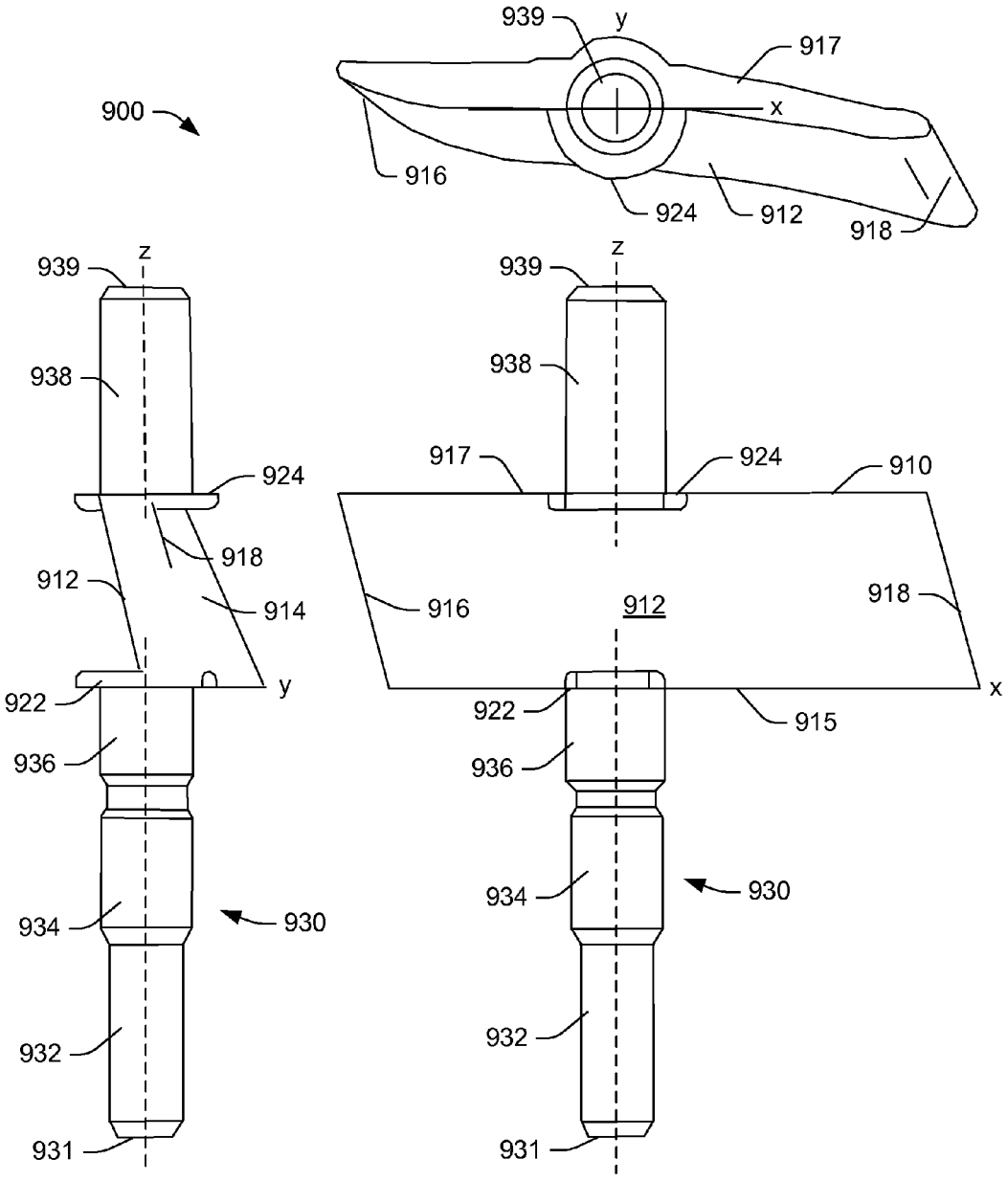
FIG. 9 is a series of views of an example of a vane.

FIG. 9 shows an example of a vane 900 with enhanced performance characteristics achieved via blended contours (3D). The vane 900 includes an airfoil 910 set on a post 930 between a lower post fixture 922 and an upper post fixture 924. The airfoil 910 includes a pair of flow surfaces 912, 914 disposed between a leading edge (LE) 916 and a trailing edge (TE) 918 and between a lower, hub surface (HS) 915 and an upper, shroud surface (SS) 917. In the example of FIG. 9, the post 930 includes post ends 931 and 939 with various cylindrical surfaces 932, 934, 936 and 938 disposed therebetween. The vane 900 may be configured with one or more different type of post configurations or, more generally, means for fixation or rotation. For example, the vane 900 may include only a lower post and be suitable for use in the turbine assembly 200 of FIG. 2.

The vane 900 of FIG. 9 may be configured, for example, with a vane width of approximately 2.5 mm to approximately 3.5 mm and a vane height of approximately 8.5 mm to approximately 9.5 mm (e.g., or other height, as appropriate to match a wheel and housing). The vane 900 of FIG. 9 may have a sweep of about −17.3 degrees, a lean of about +8.9 degrees and a twist of about +2 degrees. In a turbine assembly, about 13 vanes may be used in combination with, for example, a turbine wheel having 11 blades and a diameter of about 65 mm to about 75 mm. The wheel and vane may have a b-width of slight greater than vane height. A turbine volute of the assembly may have an A/R of about 1.2 and a correction factor of about 0.7. For about a 15% open control position, the vane throat width may be, for example, about 2.5 mm to about 3 mm. In such an assembly, the turbine wheel may be configured for rotation at speeds greater than 100,000 rpm. In various CFD analyses, a speed of 104,000 rpm, a PR of 5.4, a static exit pressure of 101325 pa, and an inlet temperature of 725 K were used for a vanes such as the vane 900 of FIG. 9.

TABLE 1

Trial Data

| Vane Name | TW (mm) | % Open | VH (mm) | N (rpm) | PR | T1T (K) | Mode 2 Strain (norm) |
|---|---|---|---|---|---|---|---|
| 1001A (400 C.) | 2.7 | 12.0 | ~9 | 104513.9 | 5.46 | 673 | 0.85 |
| 1001A (450 C.) | 2.7 | 12.0 | ~9 | 103749.5 | 5.46 | 723 | 0.97 |
| 1001A (500 C.) | 2.7 | 12.0 | ~9 | 102919.1 | 5.46 | 773 | 1 |
| 1001B (400 C.) | 3.8 | 20.0 | ~9 | 104513.9 | 5.46 | 673 | 0.60 |
| 1001B (450 C.) | 3.8 | 20.0 | ~9 | 103749.5 | 5.46 | 723 | 0.73 |
| 1001B (500 C.) | 3.8 | 20.0 | ~9 | 102919.1 | 5.46 | 773 | 0.81 |

The trial data shown in Table 1, support a conclusion that a 2D vane, exhibits reduced strain for a variety of opening values, turbine wheel speeds and temperatures.

As mentioned, the vane 900 is a 3D vane with a combination of sweep, lean and twist. FIG. 10 shows trial data for an example of a vane referred to as "Ex 2" and various combinations of features or transforms. A table 1010 shows features and trial data as strain where the lowest strain value is associated with the particular sweep, lean and twist. A table 1020 shows trial data for examples Ex 2A and Ex 2B where trial data for Ex 2A, trials were performed for both 2D and 3D configurations. These data demonstrate reduced strain. A particular example included vane sweep of approximately −17.3 degrees, vane lean of approximately +8.9 degrees and vane twist of approximately +2 degrees (e.g., negative sweep, positive lean and positive twist). A vane may be optionally configured with a sweep of about 0 degrees to about −25 degrees. A vane may be optionally configured with a lean of about 0 degrees to about +10 degrees. A vane may be optionally configured with a twist of about −5 degrees to about +5 degrees. A vane may optionally include a combination of one or more of a sweep, a lean or twist, for example, where the one or more angles may be selected from the aforementioned ranges.

Figure 11:
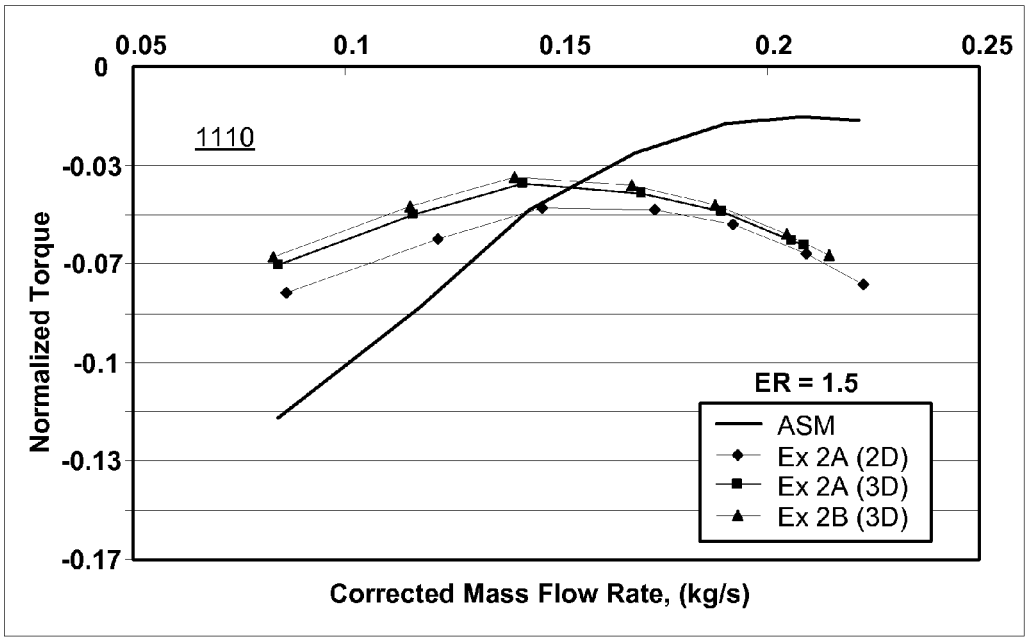
FIG. 11 is a series of plots that include trial data for various examples of vanes along with data for a standard vane.
Figure 11:
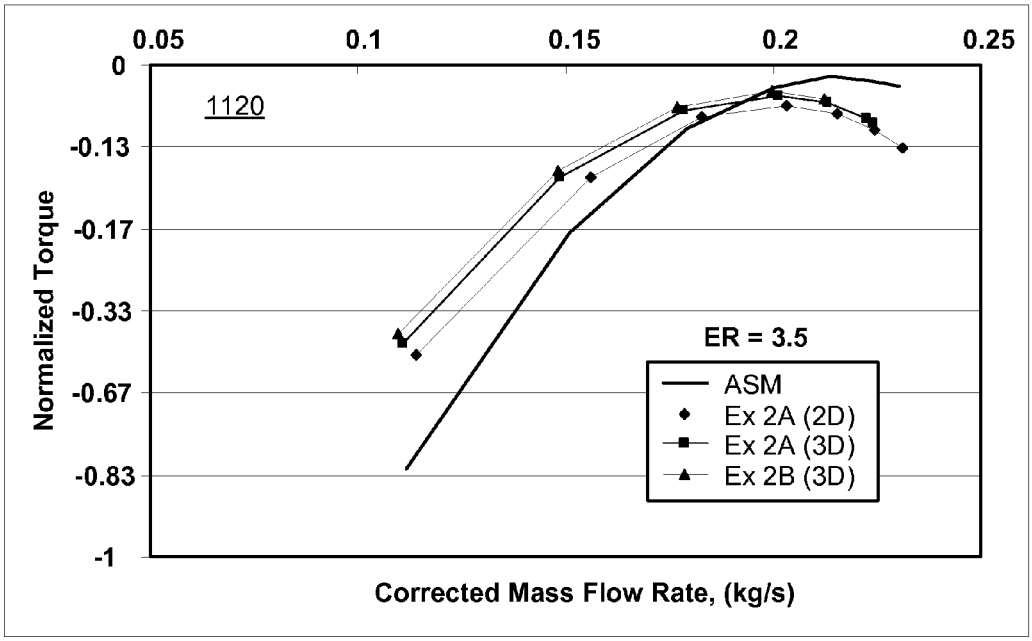

FIG. 11 shows two plots 1110 (expansion ratio, ER=1.5) and 1120 (ER=3.5) for trial data associated with the examples of table 1120 along with a standard vane (ASM). The trial data demonstrate that the vanes Ex 2A (2D), Ex 2A (3D) and Ex 2B (3D) have reduces torque over a range of corrected mass flow rates above about 0.15 (for ER=1.5) and above about 0.19 (for ER=3.5). As mentioned, reduced torque can reduce wear, increase longevity and improve controllability of vanes.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. A vane for a turbine assembly of a turbocharger, the vane comprising:

an airfoil that comprises a pair of flow surfaces disposed between a hub end and a shroud end and a leading edge and a trailing edge; a negative sweep angle, a positive lean angle and a positive twist angle; and at least two inflection points along a camberline.

2. The vane of claim 1 further comprising at least three anti-nodes along a camberline.

3. The vane of claim 1 further comprising a post.

4. The vane of claim 3 wherein the post comprises a portion extending from the hub end and a portion extending from the shroud end.

5. The vane of claim 1 comprising the sweep angle defined by a point on the trailing edge or the leading edge at the hub end and a point on the trailing edge or the leading edge at the shroud end.

6. The vane of claim 1 comprising the lean angle defined by a point on one of the flow surfaces at the hub end and a point on the one of the flow surfaces at the shroud end.

7. The vane of claim 1 comprising the twist angle defined by a camberline of the hub end of the airfoil and a camberline of the shroud end of the airfoil.

8. The vane of claim 1 wherein the angles are approximately −17 degrees, approximately +9 degrees and approximately +2 degrees, respectively.

9. A vane for a turbine assembly of an exhaust gas turbocharger comprising: a vane, the vane comprising:

an airfoil that comprises a pair of flow surfaces disposed between a leading edge and a trailing edge wherein the airfoil further comprises positive and negative camber, at least two inflection points and at least three anti-nodes along a camberline that extends between the leading edge and the trailing edge.

10. The vane of claim 9 wherein a normalized length of the camberline ranges from 0 at the leading edge to 1 at the trailing edge and wherein at least one inflection point comprises a position of at least 0.75.

11. The vane of claim 9 wherein a normalized length of the camberline ranges from 0 at the leading edge to 1 at the trailing edge and wherein at least two of the anti-nodes comprise positions of less than 0.75.

12. The vane of claim 9 wherein a normalized length of the camberline ranges from 0 at the leading edge to 1 at the trailing edge and wherein the vane comprises three anti-nodes positioned at approximately 0.2, approximately 0.7 and approximately 0.9, respectively.

13. The vane of claim 9 wherein the anti-node closest to the trailing edge comprises the smallest magnitude.

14. The vane of claim 9 wherein an intermediate one of the anti-nodes comprises the greatest magnitude.

15. A turbocharger comprising:

a center housing disposed between a compressor and a variable geometry turbine wherein the variable geometry turbine comprises a plurality of vanes wherein each vane comprises an airfoil that comprises a pair of flow surfaces disposed between a leading edge and a trailing edge and wherein the airfoil further comprises positive and negative camber, at least two inflection points and at least three anti-nodes along a camberline that extends from the leading edge to the trailing edge.

16. A vane for a turbine assembly of a turbocharger, the vane comprising:

an airfoil that comprises a pair of flow surfaces disposed between a hub end and a shroud end and a leading edge and a trailing edge; a negative sweep angle, a positive lean angle and a positive twist angle; and at least three anti-nodes along a camberline.

17. The vane of claim 16 further comprising a post.

18. The vane of claim 17 wherein the post comprises a portion extending from the hub end and a portion extending from the shroud end.

19. A vane for a turbine assembly of a turbocharger, the vane comprising:

an airfoil that comprises a pair of flow surfaces disposed between a hub end and a shroud end and a leading edge and a trailing edge; a negative sweep angle of approximately −17 degrees; a positive lean angle of approximately +9 degrees; and a positive twist angle of approximately +2 degrees.

20. The vane of claim 19 further comprising a post.

21. The vane of claim 20 wherein the post comprises a portion extending from the hub end and a portion extending from the shroud end.

* * * * *